US006472851B2

(12) United States Patent
Hammond

(10) Patent No.: US 6,472,851 B2
(45) Date of Patent: Oct. 29, 2002

(54) HYBRID TAP-CHANGING TRANSFORMER WITH FULL RANGE OF CONTROL AND HIGH RESOLUTION

(75) Inventor: Peter Hammond, Greensburg, PA (US)

(73) Assignee: Robicon Corporation, New Kensington, PA (US)

( * ) Notice: Subject to any disclaimer, the term of this patent is extended or adjusted under 35 U.S.C. 154(b) by 0 days.

(21) Appl. No.: 09/895,336

(22) Filed: Jul. 2, 2001

(65) Prior Publication Data

US 2002/0003420 A1 Jan. 10, 2002

Related U.S. Application Data

(60) Provisional application No. 60/215,884, filed on Jul. 5, 2000.

(51) Int. Cl.[7] ..... G05F 1/16

(52) U.S. Cl. ..... 323/258

(58) Field of Search ..... 323/258, 262, 323/257, 343, 260

(56) References Cited

U.S. PATENT DOCUMENTS

| | | | | |
|---|---|---|---|---|
| 3,579,092 A | | 5/1971 | Matzl | |
| 3,612,786 A | | 10/1971 | Whitman | |
| 3,617,862 A | | 11/1971 | Stich | |
| 3,662,253 A | | 5/1972 | Yamamoto | |
| 3,764,891 A | | 10/1973 | Lingenfelter et al. | |
| 3,783,206 A | | 1/1974 | Lingenfelter et al. | |
| 3,786,337 A | | 1/1974 | Kugler | |
| 3,818,402 A | | 6/1974 | Golaski et al. | |
| 3,944,913 A | | 3/1976 | Kugler | |
| 4,061,963 A | | 12/1977 | Green | |
| 4,090,225 A | | 5/1978 | Gilker et al. | |
| 4,185,177 A | | 1/1980 | Gilker et al. | |
| 4,201,938 A | | 5/1980 | Neumann | |
| 4,323,838 A | | 4/1982 | Pettigrew | |
| 4,464,547 A | | 8/1984 | Ghafourian | |
| 4,471,334 A | | 9/1984 | Watanabe et al. | |
| 4,622,513 A | | 11/1986 | Stich | |
| 4,623,834 A | | 11/1986 | Klingbiel et al. | |
| 5,128,605 A | | 7/1992 | Dohnal et al. | |
| 5,266,759 A | | 11/1993 | Dohnal et al. | |
| 5,408,171 A | * | 4/1995 | Eitzmann et al. | 323/258 |
| 5,461,300 A | | 10/1995 | Kappenman | |
| 5,604,424 A | | 2/1997 | Shuttleworth | |
| 5,726,561 A | | 3/1998 | Ghosh et al. | |
| 5,744,764 A | | 4/1998 | Aschenbrenner et al. | |

* cited by examiner

*Primary Examiner*—Shawn Riley
(74) *Attorney, Agent, or Firm*—Buchanan Ingersoll

(57) ABSTRACT

A hybrid tap-changer for delivering AC power to a load in which a high-power tap-changing transformer with full range of adjustment but limited resolution is combined with a low-power electronic converter of limited range but high resolution to provide a tap-changing transformer with high resolution.

22 Claims, 8 Drawing Sheets

SEQUENCE OF OPERATION

| POSITION | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| SWITCH-1 | O | O | | | | | | | | | | | | | | | |
| " -2 | | O | O | O | | | | | | | | | | | | | |
| " -3 | | | | O | O | O | | | | | | | | | | | |
| " -4 | | | | | | O | O | O | | | | | | | | | |
| " -5 | | | | | | | | O | O | O | | | | | | | |
| " -6 | | | | | | | | | | O | O | O | | | | | |
| " -7 | | | | | | | | | | | | O | O | O | | | |
| " -8 | | | | | | | | | | | | | | O | O | O | |
| " -9 | | | | | | | | | | | | | | | | O | O |
| " -R | O | O | | O | O | O | | O | O | O | | O | O | O | | O | O |
| " -S | | O | O | O | | O | O | O | | O | O | O | | O | O | O | |
| " -T | O | | | | O | | | | O | | | | O | | | | O |

O=SWITCH CLOSED

SEQUENCE OF OPERATION

| POSITION | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| SWITCH-1 | O | O | | | | | | | | | | | | | | | |
| " -2 | | O | O | O | | | | | | | | | | | | | |
| " -3 | | | | O | O | O | | | | | | | | | | | |
| " -4 | | | | | | O | O | O | | | | | | | | | |
| " -5 | | | | | | | | O | O | O | | | | | | | |
| " -6 | | | | | | | | | | O | O | O | | | | | |
| " -7 | | | | | | | | | | | | O | O | O | | | |
| " -8 | | | | | | | | | | | | | | O | O | O | |
| " -9 | | | | | | | | | | | | | | | | O | O |
| " -R | O | O | | O | O | O | | O | O | O | | O | O | O | | O | O |
| " -S | | O | O | O | | O | O | O | | O | O | O | | O | O | O | |
| " -T | O | | | | O | | | | O | | | | O | | | | O |

O=SWITCH CLOSED

HYBRID TAP-CHANGING TRANSFORMER WITH FULL RANGE OF CONTROL AND HIGH RESOLUTION

RELATED APPLICATIONS

This application claims the benefit of U.S. provisional application Ser. No. 60/215,884, filed Jul. 5, 2000.

FIELD OF THE INVENTION

This invention discloses an advancement in the field of power control, and, in particular, in the field of transformers providing variable power for high power applications by changing tap connections on the transformer.

BACKGROUND OF THE INVENTION

Apparatus to change the tap connections on a transformer under load is well known in the art and is available from several manufacturers. It is a proven, efficient, and cost-effective way to adjust voltage in high-power applications where rapid response is not required.

One usual shortcoming of available tap-changing apparatus is that only a limited range of voltage adjustment is allowed; typically ±10%. One reason is that there is a practical limit to the number of taps that can be provided on a transformer. With a limited number of taps, the range of adjustment can be extended only by increasing the spacing between the taps; which sacrifices resolution.

However, there are many high-power applications that need full-range control of voltage with high resolution, but do not require rapid response. Examples of such applications include electrical heating of materials in the manufacture of semiconductors and abrasives, electric refining of metals, electric plating of metals, electric melting of glass, and electrochemical production of chemicals such as chlorine. Such applications typically use electronic converters based on semiconductor switches for voltage control. These solutions have the advantage of full-range control with high resolution and rapid response; but they often have the disadvantages of harmonic currents, poor power-factor, poor efficiency, and significant waste heat.

FIG. 1 shows a prior art mechanical tap-changer. Only a single phase circuit is shown, or, more generally, one of three identical phases. The transformer secondary winding has been divided into two parts, 10*a* and 10*b*. Secondary winding 10*b* contains a plurality of taps. An arrangement of contacts, R, S, & T, are shown to change the tap settings of the partial winding while under load. Contacts R, S, and T are capable of opening with current flowing and of closing with voltage present. Selector switches, numbered 1–9, do not have or need this capability.

Selector switches 1–9 are arranged in two groups, one group for the odd-numbered taps 12*a* and one group for the even-numbered taps, 12*b*. If one of the odd-numbered taps is in use, contacts R and T will be closed and contact S is opened. To transfer to an adjacent even-numbered tap, contact T is first opened. Preventive auto-transformer 14 is constructed to have an impedance low enough that it can carry the load current after contact T is opened, but high enough to limit the current between taps when contacts R and S are both closed.

After contact T has opened, contact S is closed. The load current now divides between two taps, while the load voltage assumes the mean value between the two taps. Some current will circulate between the taps, but will be limited by the impedance of preventive auto-transformer 14. After contact S has closed, contact R is opened. The load current now flows entirely from the selected even-numbered tap. Preventive auto-transformer 14 carries this load current by means of its low impedance as before. Finally, after contact R has opened, contact T is closed. This shorts-out preventive auto-transformer 14 and eliminates the voltage drop due to its impedance.

Selector switches 1–9 are controlled by two separate but interlocked mechanisms, one for odd-numbered group 12*a* and one for even-numbered group 12*b*. Odd-numbered switches 12*a* are never changed unless contact R is opened, while even-numbered switches 12*b* are never changed unless contact S is opened. This ensures that no current is present on the selector-switches when they are opened, and that no voltage is present on the selector-switches when they are closed.

In FIG. 1 the selected voltage from the tapped partial winding 10*b* is connected only to boost or add to the voltage from the un-tapped partial winding 10*a*. It is also possible to connect them to buck, or subtract. FIG. 2 shows such a configuration. In FIG. 2, reversing switches A, B, C, and D have been added so that the selected voltage from tapped partial winding 10*b* can either be added to or subtracted from the voltage from the un-tapped partial winding 10*a*. This allows a smaller number of taps to achieve the same total number of selections.

FIG. 3 shows a variation on FIG. 1, in which the windings of preventive auto-transformer 14 are separated into two half-windings, C1 and C2. Contacts R, S, and T can then be moved downstream of these windings, which allows contact T to be the only one capable of opening with current flowing or closing with voltage present. In FIG. 3 only part of the tapped winding is shown, including only two of the selector switches, B1 and B2.

FIG. 3 also shows an additional improvement over FIG. 1, in that the auto-transformer is designed to permit continuous operation while supporting the voltage between two adjacent taps. This allows the control strategy to include operating modes in which two adjacent selector switches are closed simultaneously, as shown in configuration A in FIG. 3. The auto-transformer then causes the load voltage to be the average of the two tap voltages. This has the same effect as doubling the number of taps, and improves the resolution.

SUMMARY OF THE INVENTION

This invention comprises a hybrid configuration for applications that do not require rapid response. A high-power tap-changing transformer with full range of adjustment but limited resolution is combined with a low-power electronic converter of limited range but high resolution. The electronic converter provides the ability to adjust the voltage between the spaced taps of the main transformer, so that the combination exhibits high resolution. In this arrangement, the majority of the power is processed by the tap-changing transformer, where it benefits from high efficiency, high power-factor, and the absence of harmonics. Only a small fraction of the power is processed by the electronic converter, such that its associated disadvantages are proportionately diminished.

An embodiment of the invention is disclosed in which the invention is used to ensure that the mechanical switches in the tap-changer are opened only under conditions of low current and closed only under conditions of low voltage, so that contact wear due to arcing is reduced. This allows components normally found in tap-changers for the purpose of arc-reduction to be eliminated, simplifying the mechanical apparatus and recovering part of the cost of the electronic converter.

An alternate configuration is further disclosed in which the mechanical switches in the tap-changer are replaced by semiconductor switches. This configuration of the electronic converter ensures that the semiconductor switches in the tap-changer are opened only under conditions of low current and closed only under conditions of low voltage, which simplifies the associated circuits for voltage-sharing, for dV/dT suppression, and for driving the gates. While not quite as efficient as the mechanical tap-changer, this alternative still has the benefits of high efficiency, high power-factor, and low harmonics. It may be preferred at lower power levels, or when oil-filled components cannot be employed.

DETAILED DESCRIPTION OF THE INVENTION

Figure 1:
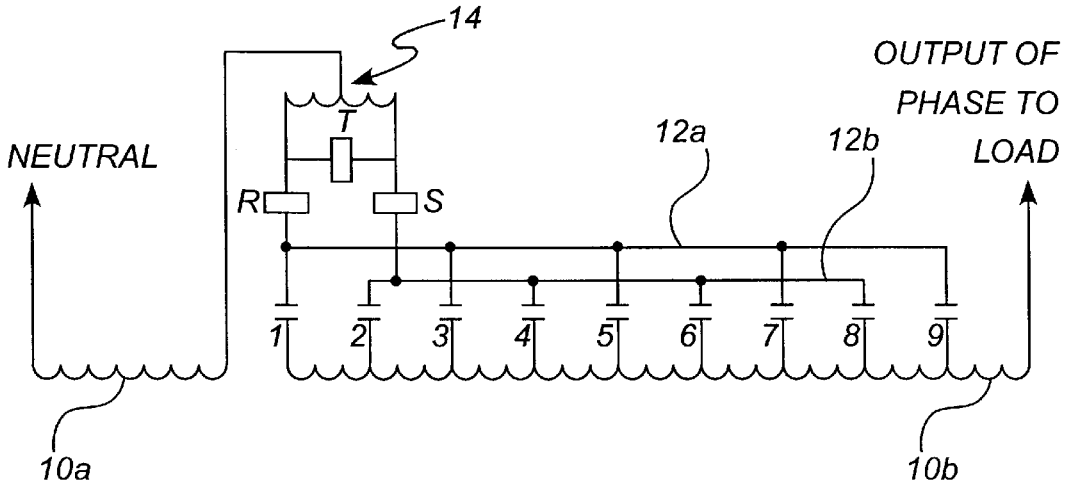
FIG. 1 (Prior Art)
FIG. 1 shows a prior art mechanical tap changer.
Figure 2:
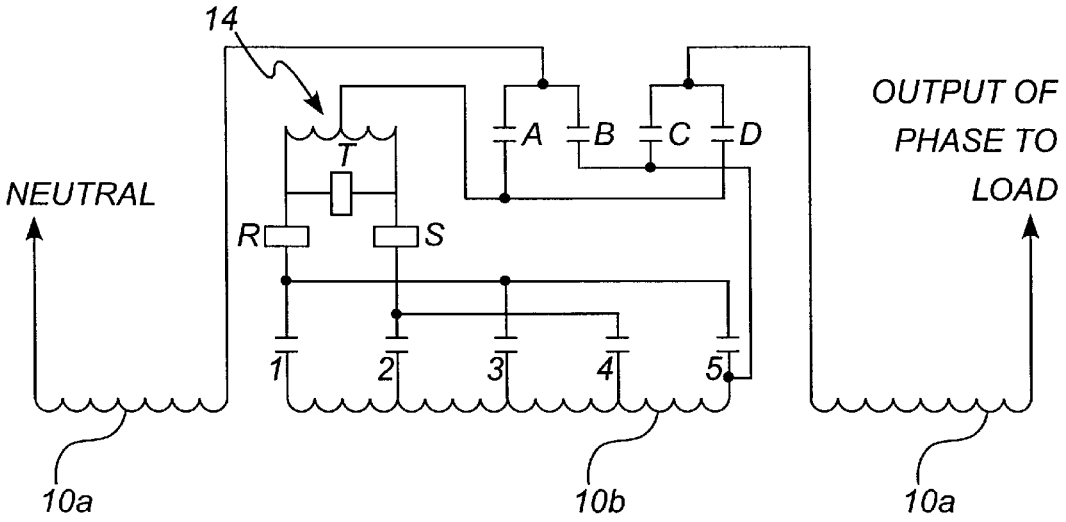
FIG. 2 (Prior Art)
FIG. 2 shows an alternate embodiment of the prior art tap changer of FIG. 1 wherein the tapped and untapped voltages can be subtracted as well as added.
Figure 4:
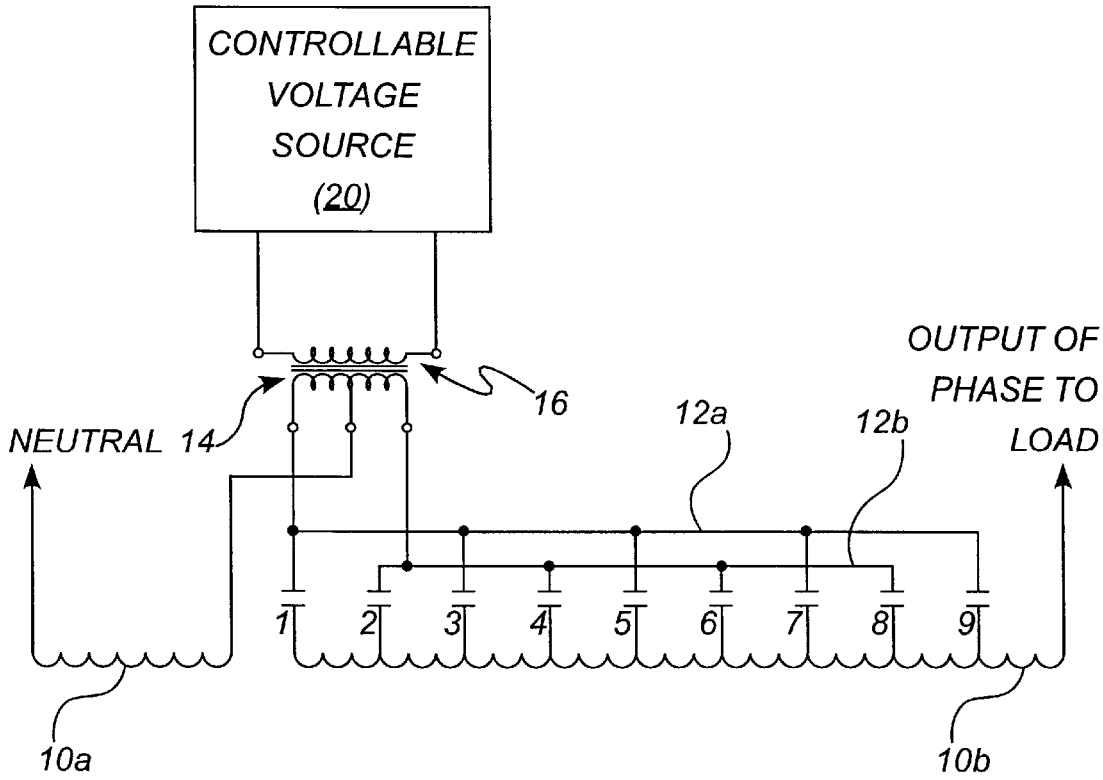
FIG. 4 shows improvements according to the invention of the tap changer of FIG. 1.
Figure 5:
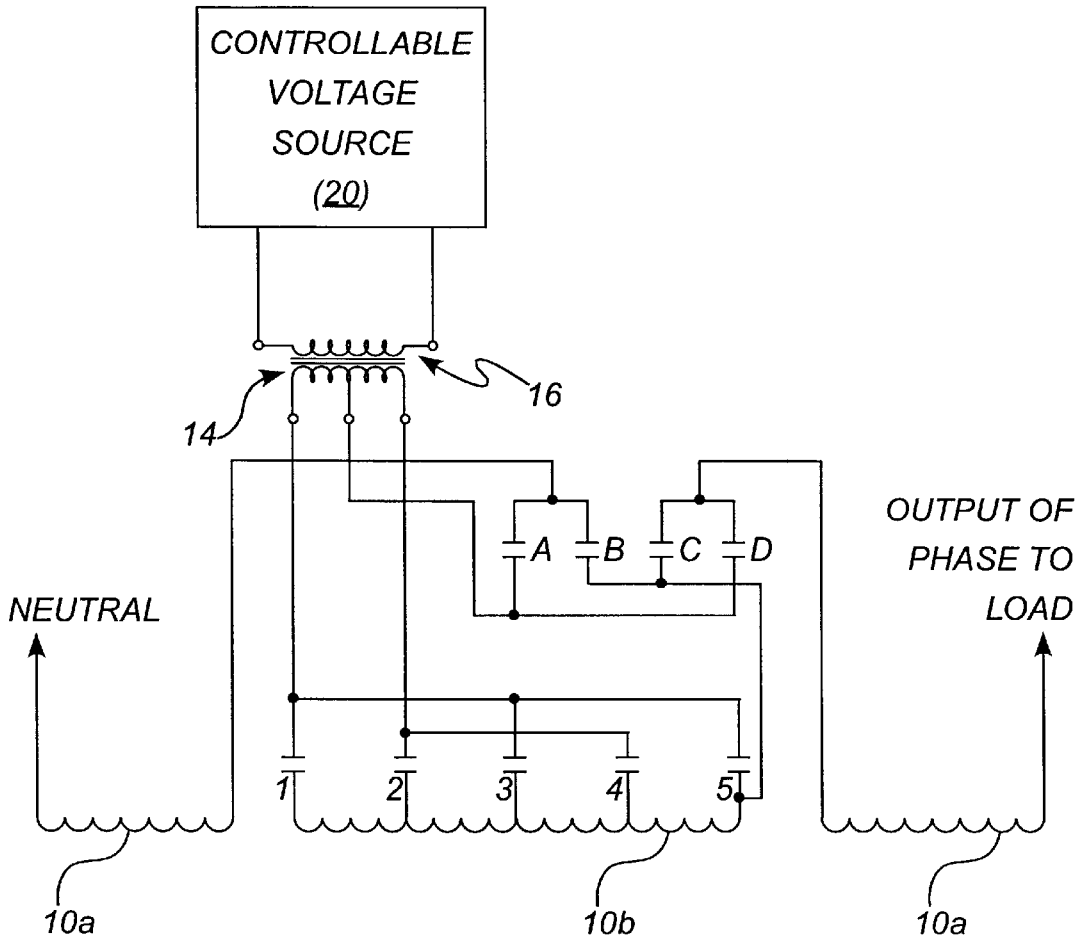
FIG. 5 show the improvements according to this invention to the tap changer of FIG. 2.

FIG. 4 shows an improvement to the tap-changer circuit of FIG. 1 according to the present invention. FIG. 5 shows the same improvement corresponding to the tap-changer circuit of FIG. 2. In both cases, winding 16 has been added to preventive auto-transformer 14, and the added winding has been connected to a controllable source of AC voltage 20. Contacts R, S, and T have been removed.

A description of the operation of the circuits will be given by example. Suppose that selector switch 4 is closed and that the controllable source is producing zero volts, but that the load requires a higher voltage. For a small increase in voltage, controllable voltage source 20 can increase its output voltage with such a polarity that the voltage induced into the right half of the original winding of preventive auto-transformer 14 adds to the voltage from tap 4. This process can be continued until the voltage on the center-tap of the original winding of preventive auto-transformer 14 reaches the mean value between tap 4 and tap 5. At this point the voltage across the entire original winding of preventive auto-transformer 14 will be equal to the differential voltage between tap 4 and tap 5, so that the voltage remaining across selector switch 5 is very small. Therefore selector switch 5 can be closed with minimal arcing, and with minimal disturbance to the load.

If the load requires still more voltage, it is necessary to transfer from tap 4 to tap 5. As described above, selector switch 5 has been closed. Some of the load current will begin flowing through tap 5 instead of tap 4. By monitoring the current flowing in the added winding 16 and comparing it to the load current, controllable voltage source 20 can calculate the current still flowing in tap 4, and can adjust its output until the current in tap 4 is zero. At this point, selector switch 4 can be opened with minimal arcing, and with minimal disturbance to the load.

At this point the voltage on the center-tap of the original winding of preventive auto-transformer 14 is still equal to the mean value between tap 4 and tap 5, but it is now obtained by subtracting the voltage on the original winding of preventive auto-transformer 14 from tap 5 instead of by adding the voltage on the original winding of preventive auto-transformer 14 to tap 4. Therefore the output voltage can be increased further by reducing the output of controllable source 20 to zero, and then by reversing the polarity of controllable source 20 and increasing it. If necessary, when the voltage across the entire original winding becomes equal to the entire differential voltage between tap 5 and tap 6, it will be possible to close selector switch 6 and then open selector switch 5 in the same manner, with minimal arcing and with minimal disturbance to the load.

Three benefits have been achieved by this improvement. First, the load voltage is now continuously variable, and can assume any value, rather than being limited to the discrete values determined by the tap locations. The second benefit is that contacts R, S, and T with arcing capability have been eliminated, reducing cost and maintenance. The third benefit is that controllable voltage source 20 can be designed for much less than the maximum power required by the load.

Figure 3:
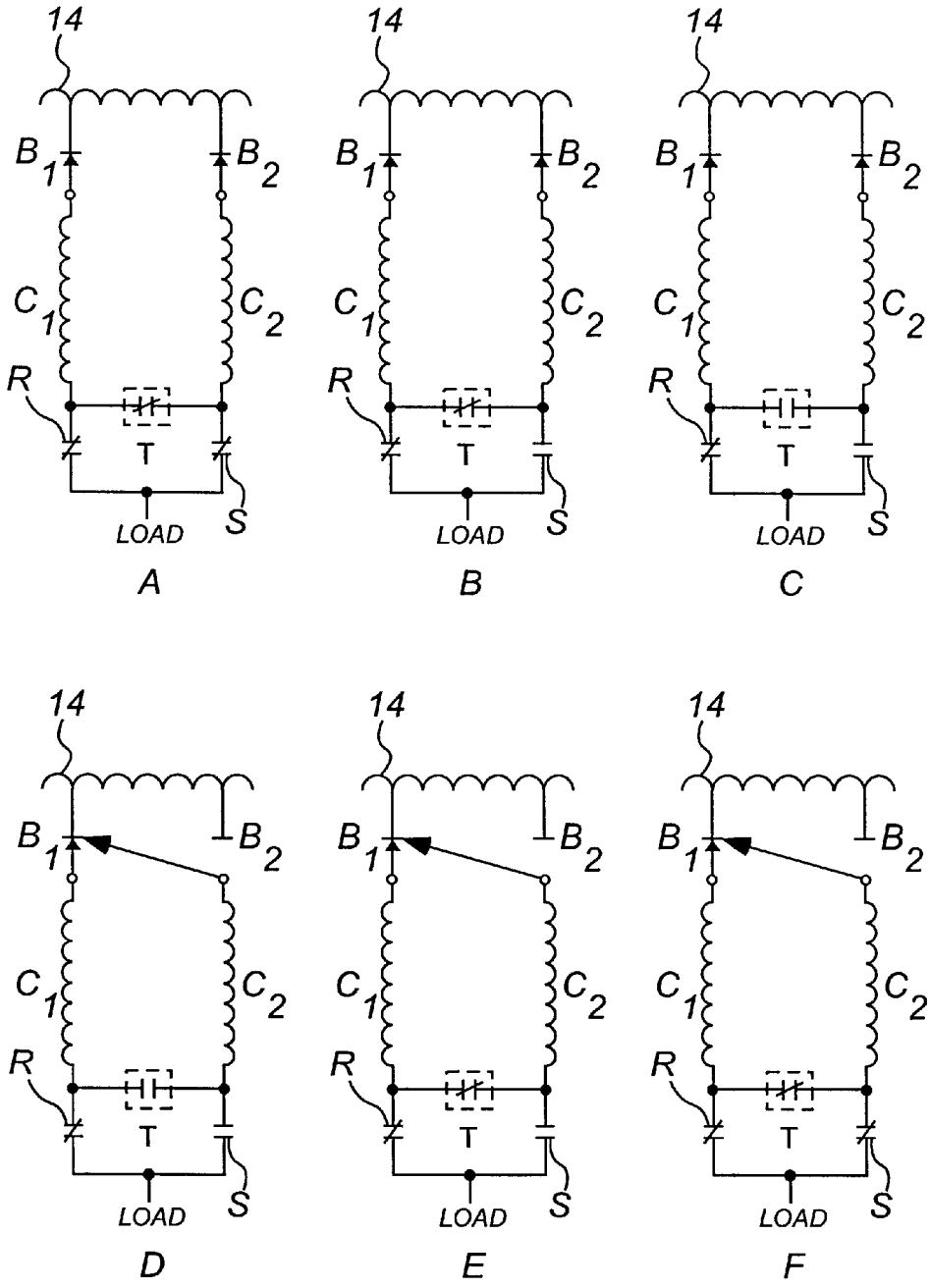
FIG. 3 (Prior Art)
FIG. 3 shows further prior art refinements of the tap changer of FIG. 1.

The same improvement can also be applied to the prior art circuits of FIG. 3. This will readily be apparent by noticing that when the contacts R, S and T in FIG. 3 have been eliminated, the two half-windings C1 and C2 in FIG. 3 will become re-connected to form a single center-tapped winding identical to FIG. 1 or 2.

Figure 6:
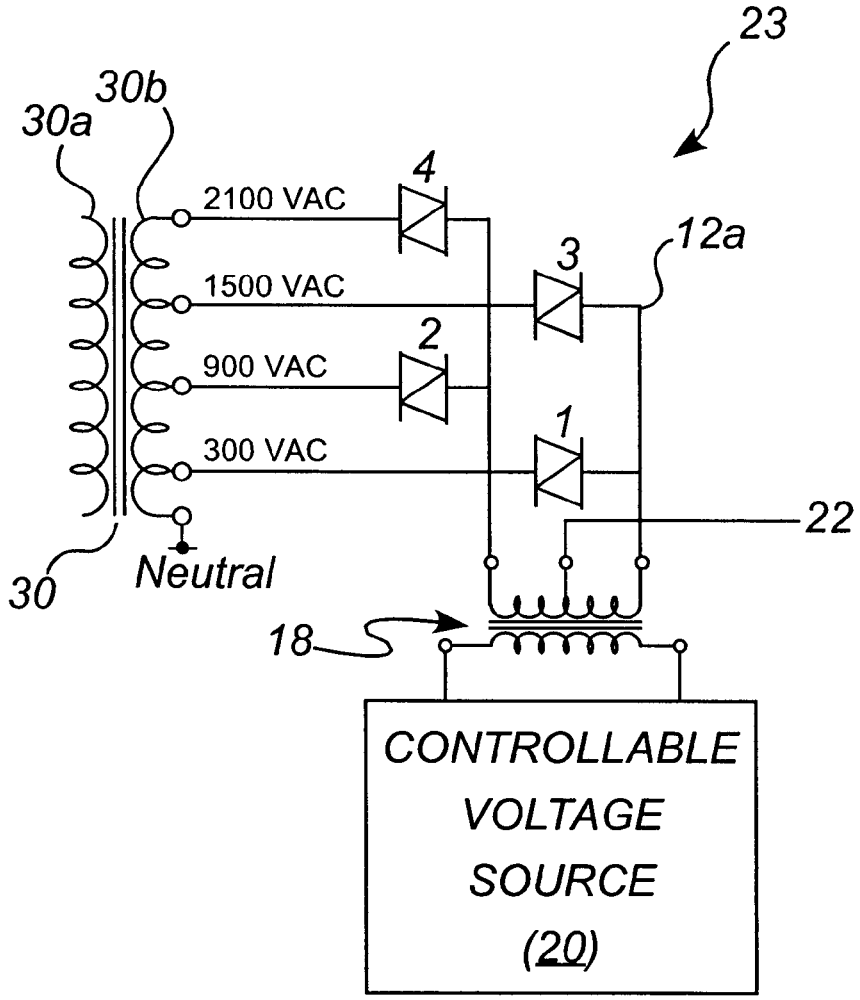
FIG. 6 shows an alternate embodiment wherein the mechanical switches of the tap changer are replaced by semiconductor switches.

In an alternate embodiment, the same concept described above for a mechanical tap-changer can also be employed if the mechanical switches are replaced by semiconductor switches 1–4, as in the simple example shown in FIG. 6. Switches 1–4 can be any connection of semiconductor devices that can conduct current of either polarity when ON, and can block voltage of either polarity when OFF. This same symbol is used in subsequent figures. In FIG. 6, transformer 30 represents one phase of a large transformer, with primary winding 30*a* and secondary winding 30*b*. All three primary windings of transformer 30 would normally be connected in a DELTA configuration, while the three secondary windings would be connected in a WYE configuration. Both primary and secondary windings 30*a* and 30*b* respectively can be wound for any convenient voltage. In the example shown in FIG. 6, it is desired to have a maximum output voltage of 4160 volts RMS line-to-line, which is equivalent to 2400 volts RMS line-to-neutral. Each phase of secondary winding 30*b* is wound for a maximum of 2100 volts RMS line-to-neutral, with taps at 1500 volts, 900 volts, and 300 volts (all referenced to neutral). Four semiconductor switches are provided in two groups, one group for the odd-numbered taps 12*a* and one group for the even-numbered taps 12*b*. An auxiliary transformer 18 is provided equivalent to the modified preventative auto-transformer 14 with added winding 16 in FIGS. 4 and 5. The primary winding of auxiliary transformer 18 is driven from controllable voltage source 20, while the secondary winding of auxiliary transformer 18 is connected between the outputs of the two groups of semiconductor switches 12*a* and 12*b*, and is provided with a center-tap 22 which feeds the load.

In the example of FIG. 6, controllable voltage source 20 and auxiliary transformer 18 are designed to be capable of generating 300 volts RMS on either half of the secondary winding. For example, to produce an output of zero volts, semiconductor switch 1 is closed so that 300 volts RMS from the lowest tap of secondary winding 30*b* appears on the right side of the secondary of auxiliary transformer 18. At the same time, controllable voltage source 20 is set to produce 300 volts RMS across the right half of the secondary winding of auxiliary transformer 18, with a polarity such that it subtracts from the voltage selected by semiconductor switch 1. The net output voltage to the load is therefore zero.

To increase the load voltage above zero, the output from controllable voltage source 20 is gradually reduced, so that the voltage across the right half of the secondary winding of auxiliary transformer 18 is less than 300 volts RMS. When this is subtracted from the voltage selected by semiconductor switch 1, it leaves a remainder greater than zero. This process can be continued until the output of controllable voltage source 20 and of auxiliary transformer 18 becomes zero, at which point the load voltage is 300 volts RMS line-to-neutral.

To further increase the load voltage, the polarity of controllable voltage source 20 is reversed, and its output voltage is gradually increased. When the voltage across the right half of the secondary winding of auxiliary transformer 18 is again equal to 300 volts RMS, with the opposite polarity, the load voltage will be 600 volts RMS line-to-neutral. At this point the voltage on the left terminal of the secondary of auxiliary transformer 18 will be 900 volts (reference to neutral), so that semiconductor switch 2 can be closed with minimum transient and minimum disturbance to the load. Once semiconductor switch 2 is closed, semiconductor switch 1 can then be opened with minimum transient and minimum disturbance to the load. The load voltage is still 600 volts RMS line-to-neutral, but it is now obtained by subtracting 300 volts produced by auxiliary transformer 18 from 900 volts selected by semiconductor switch 2, instead of by adding 300 volts produced by auxiliary transformer 18 to 300 volts selected by semiconductor switch 1.

The process described above can be repeated to transfer smoothly from one tap to the next, until the maximum output of 2400 volts RMS line-to-neutral is achieved. This will be obtained by selecting the 2100 volt tap using semiconductor switch 4, and by adding to this voltage a further 300 volts produced by controllable voltage source 20 and auxiliary transformer 18.

Note that throughout this process, controllable voltage source 20 and auxiliary transformer 18 never need to produce more than 300 volts of either polarity, even when the load voltage is 2400 volts RMS line-to-neutral. It follows that controllable voltage source 20 and auxiliary transformer 18 never generate more than ⅛ of the maximum power required by the load.

For a small system the single tap-changer stage shown in FIG. 6 may be sufficient, and controllable voltage source 20 and auxiliary transformer 18 may be designed for ⅛ of rated power as shown. However, for a large system, even ⅛ of rated power may be undesirable. In that case a cascaded system as shown in the example of FIG. 7 may be preferred.

Figure 7:
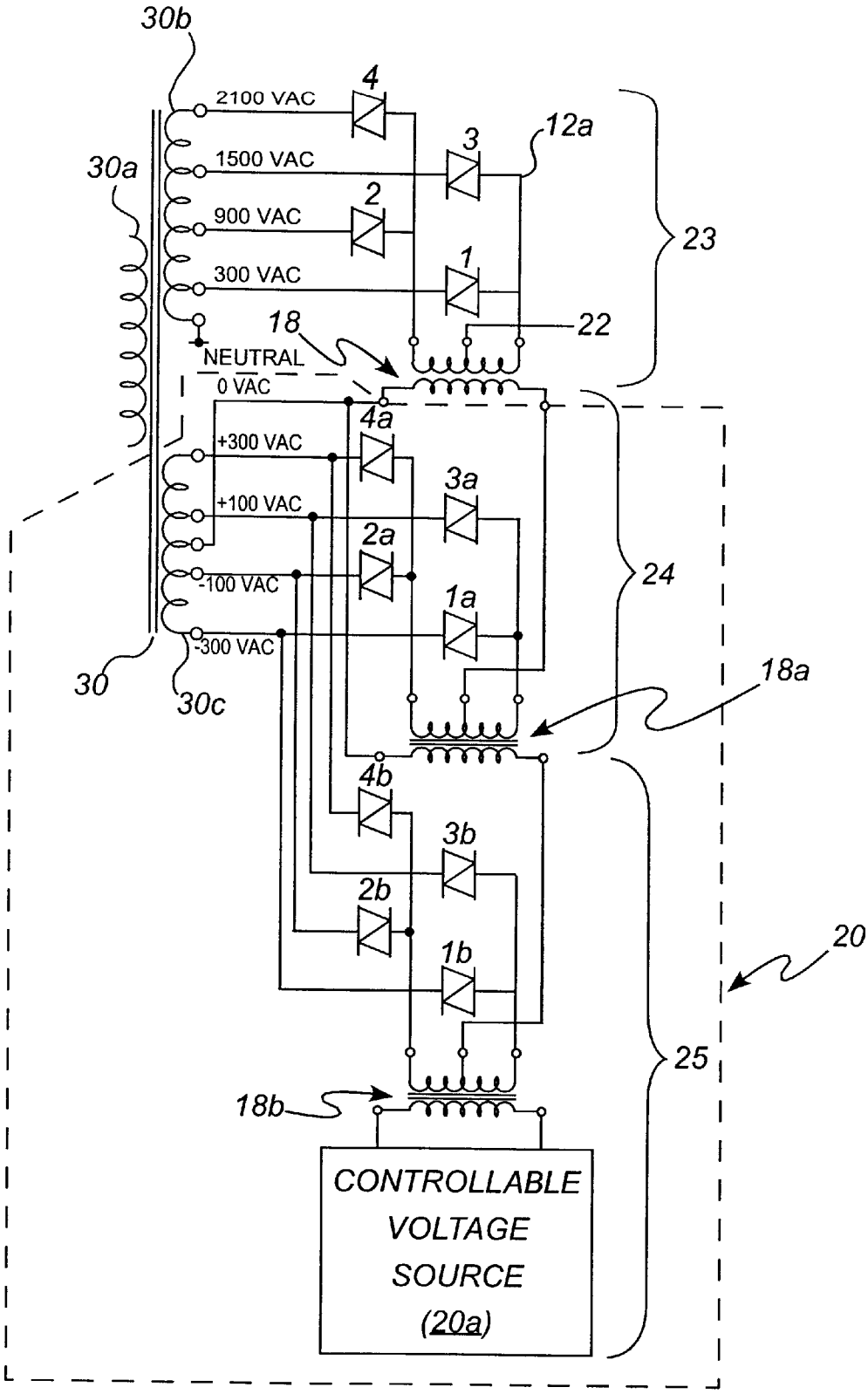
FIG. 7 shows a multi-stage hybrid tap changer according to this invention.

As an example, assume in FIG. 7 that the maximum load power is 2000 KVA per phase, so that semiconductor switches 1–4 must be sized for 2000 KVA. As described above, auxiliary transformer 18 and the controllable voltage source driving auxiliary transformer 18 must be rated for 250 KVA. However, as shown in FIG. 7, the controllable voltage source driving auxiliary transformer 18 can itself be a combination of a smaller tap-changer and a smaller controllable voltage source 24 and 25. In FIG. 7, second stage 24 consists of a tap-changer with semiconductor switches 1*a*–4*a,* which are all sized for 250 KVA. Because second stage 24 must operate over both polarities of voltage and power, there is only a four-fold reduction in the power rating of auxiliary transformer 18*a,* which is sized for about 63 KVA.

Furthermore, the controllable voltage source driving auxiliary transformer 18*a* is also a combination of a still smaller tap-changer and a still smaller controllable third stage voltage source 25. Semiconductor switches 1*b*–4*b* are sized, like auxiliary transformer 18*a* for about 63 KVA.

Because third stage 25 must also operate over both polarities of voltage and power, there is only a four-fold reduction in the power rating of auxiliary transformer 18*b,* and controllable voltage source 20 that drives it, which are both sized for about 16 KVA.

Note that in FIG. 7 both the second and third stages 24 and 25 respectively, and also the final controllable voltage source 20, receive power from a second secondary winding 30*c* on transformer 30. This was done to allow the use of lower voltage ratings for the semiconductor switches than were needed in the first stage, because the devices available at the lower power ratings are generally limited to lower voltage ratings. However, in principle, all stages could have been powered by the first secondary winding 30*b* on transformer 30.

Final controllable voltage source 20*a* will be less costly to implement at 16 KVA than at 250 KVA. However, it will still be just as complex if it must still provide full control of its output voltage and polarity, with power flowing through it in either direction. Such a design is mandatory with only one tap-changer stage, in order to achieve high resolution. However, because each of the three cascaded tap-changers in FIG. 7 can select from four distinct taps, the combination of all three tap-changers has $4^3$ or 64 discrete states. The tap-changers by themselves already have fairly good resolution. If the load does not require infinite resolution, which is usually the case, then it may be possible to greatly simplify the design of controllable voltage source 20*a* in FIG. 7. For example, if the controllable voltage source 20*a* in FIG. 7 has only three possible states, corresponding to outputs on auxiliary transformer 18 of +100 volts, 0 volts, and −100 volts, then the complete system of FIG. 7 will still be able to make transient-free transfers from tap to tap. It will have 128 states, or 128 discrete levels of output voltage. This provides resolution better than 1%, and will often be sufficient for the process being controlled.

Figure 8:
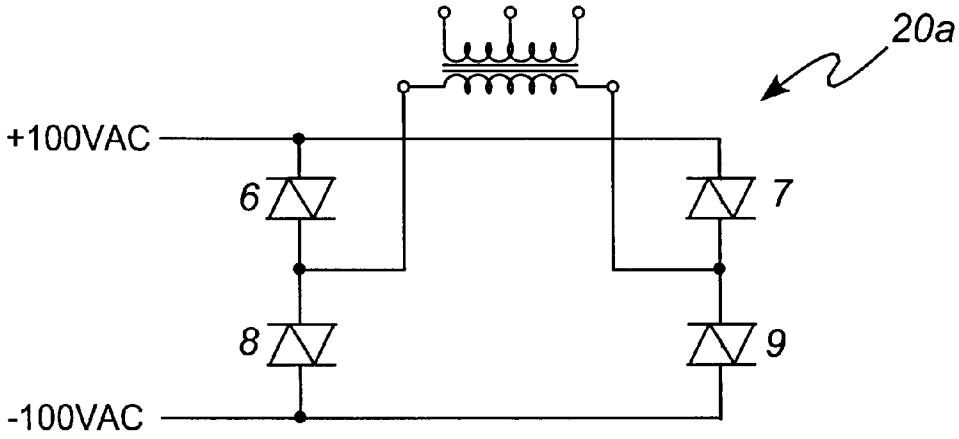
FIG. 8 shows one possible design for the controlled voltage source used in all of the tap changers according to the present invention.

One possible design for such a three output state controllable voltage source 20*a* is shown in FIG. 8. In FIG. 8, if semiconductor switches 6 and 9 are ON, the left side of auxiliary transformer 18*b* receives +100 VAC, while the right side of auxiliary transformer 18*b* receives −100 VAC. If semiconductor switches 7 and 8 are ON, the left side of auxiliary transformer 18*b* receives −100 VAC, while the right side of auxiliary transformer 18*b* receives +100 VAC. If semiconductor switches 6 and 7 are ON, auxiliary transformer 18*b* receives zero volts. If semiconductor switches 8 and 9 are ON, auxiliary transformer 18*b* also receives zero volts.

Note that the first two stages 23 and 24 in FIG. 7 provide 16 states, or 16 discrete levels of output voltage. As is commonly known in the art, 16 is a common number of tap positions for the prior art mechanical tap changers of FIGS. 1, 2, and 3. Therefore, such a 16 position mechanical tap-changer is equivalent in function to first stage 23 plus second stage 24 of FIG. 7. If this substitution is made, then third stage 25 together with controllable voltage source 20 shown in FIG. 7 become the controllable voltage source 20 shown in FIG. 4 or 5.

It is not required that the voltage spacing of the taps be uniform, but the auxiliary transformer and its controller must be capable of matching the largest spacing. For this reason it is preferred that that the voltage spacing of the taps be uniform.

All examples used herein to describe the operation of the invention are meant to be exemplary only. No limitations, especially due to specific voltages used in the examples, are meant to be implied by their use. Although the most common use of the apparatus described is in high-power applications, the total voltage capacity of an apparatus according to this invention may include voltages of any given range. The specific bound of the invention are set forth in the following claims.

I claim:

1. A hybrid tap-changer for providing adjustable AC voltage to a load of defined maximum power, comprising:

a main transformer, having a secondary winding with a plurality of taps, each of said taps providing a tap voltage;

a plurality of switches, connected to said taps for selecting said taps; and a controllable voltage source, coupled so that its output is added to or subtracted from said selected tap voltage.

2. The tap-changer of claim 1 further comprising an auxiliary transformer for coupling said controllable voltage source to said one or more selected taps.

3. The tap-changer of claim 1 wherein said controllable voltage source must deliver at least the maximum voltage between any two adjacent taps.

4. The tap-changer of claim 1 wherein each of said switches is selected from the group comprising a mechanically operated contact switch and a semiconductor-based switch.

5. The tap-changer of claim 1 wherein:

the voltage across any one of said switches is minimized prior to closing said switch; and the current through any one of said switches is minimized prior to opening said switch.

6. The tap-changer of claim 2 wherein:

said auxiliary transformer has a primary winding and a secondary winding and said secondary winding of said auxiliary transformer has a center tap;

said output from said controllable voltage source is connected to said primary winding of said auxiliary transformer;

a first subset of said switches connected to alternating taps is connected to one side of said secondary winding of said auxiliary transformer;

a second subset of said switches connected to adjacent alternating taps is connected to the opposite side of said secondary winding of said auxiliary transformer; and said center tap of said secondary winding of said auxiliary transformer delivers said AC voltage to said load.

7. The tap-changer of claim 6 wherein only one switch from each of said first and second subsets of switches may be closed at any given time.

8. The tap-changer of claim 1 wherein the output from said controllable voltage source is added to the voltage of said selected tap when the desired load voltage is greater than the voltage of said selected tap.

9. The tap-changer of claim 8 wherein the output from said controllable voltage source is subtracted from the voltage of said selected tap when the desired load voltage is less than the voltage of said selected tap.

10. The tap-changer of claim 9 wherein:

the polarity of said output of said controllable voltage source reverses when the desired load voltage transitions form being less than to greater than the selected tap voltage, or vice-versa.

11. The tap-changer of claim 2 wherein said AC voltage can be varied by adding or subtracting the voltage from said controllable voltage source to or from the voltage from said selected tap, depending upon the polarity of the voltage from said controllable voltage source.

12. The tap-changer of claim 1 wherein:

the tap on said secondary winding of said main transformer delivering the highest voltage has a voltage less than the maximum required by the load, and the maximum power capability of said tap-changer obtained by adding the maximum voltage output from said controllable voltage source to the tap voltage of the tap on said secondary winding of said main transformer delivering the highest voltage.

13. The tap-changer of claim 1 wherein said controllable voltage source is comprised of a second tap-changer.

14. In a device for providing adjustable AC voltage to a load having a main transformer with a secondary winding with a plurality of taps, a plurality of switches, connected to said taps for selecting said taps, said taps divided into a first group comprised of alternating taps and a second group comprised of adjacent alternating taps, said first group of taps being coupled to one side of the secondary winding of an auxiliary transformer and said second group of taps being coupled to the opposite side of the secondary winding of said auxiliary transformer, and a controllable voltage source coupled to the primary winding of said auxiliary transformer, a method of varying said AC voltage comprising:

raising said voltage from said controllable voltage source until the differential voltage between the currently selected tap and an adjacent tap is reached;

closing said switch connected to said adjacent tap;

opening said switch connected to said currently selected tap;

lowering said voltage from said controllable voltage source until zero volts is reached; and reversing the polarity of said voltage from said controllable voltage source.

15. In a device for providing adjustable AC voltage to a load having a main transformer with a secondary winding with a plurality of taps, a plurality of switches, connected to said taps for selecting said taps, said taps divided into a first group comprised of alternating taps and a second group comprised of adjacent alternating taps, said first group of taps being coupled to one side of the winding of an auto-transformer and said second group of taps being coupled to said opposite side of the winding of an auto-transformer, an improvement comprising:

a primary winding coupled to said winding of said auto-transformer; and a controllable voltage source coupled to the primary winding of said auto-transformer.

16. The improvement of claim 15 wherein said controllable voltage source must deliver at least the maximum voltage between any two adjacent taps.

17. The improvement of claim 15 wherein each of said switches is selected from the group comprising a mechanically operated contact switch and a semiconductor-based switch.

18. The improvement of claim 15 wherein:

the voltage across any one of said switches is minimized prior to closing said switch; and the current through any one of said switches is minimized prior to opening said switch.

19. The improvement of claim 15 wherein only one switch from each of said first and second subsets of switches may be closed at any given time.

20. The improvement of claim 15 wherein said controllable voltage source is comprised of a second tap-changer.

21. The tap-changer of claim 2 wherein:

said auxiliary transformer has a primary winding and a secondary winding and said secondary winding of said auxiliary transformer has a center tap;

said output from said controllabe voltage source is connected to said primary winding of said auxiliary transformer;

a first subset of said switches connected to alternating taps is connected to one side of said secondary winding of said auxiliary transformer;

a second subset of said switches connected to adjacent alternating taps is connected to the opposite side of said secondary winding of said auxiliary transformer; and said center tap of said secondary winding of said auxiliary transformer delivers said AC voltage to said load.

22. The tap-changer of claim 21 wherein only one switch from each of said first and second subsets of switches may be closed at any given time.

* * * * *

UNITED STATES PATENT AND TRADEMARK OFFICE

CERTIFICATE OF CORRECTION

PATENT NO. : 6,472,851 B2
DATED : October 29, 2002
INVENTOR(S) : Peter Hammond

It is certified that error appears in the above-identified patent and that said Letters Patent is hereby corrected as shown below:

Column 10,
Line 1, change “controllabe” to -- controllable --.

Signed and Sealed this

Twenty-fifth Day of February, 2003

JAMES E. ROGAN
*Director of the United States Patent and Trademark Office*